US008358956B2

(12) United States Patent
Eder et al.

(10) Patent No.: US 8,358,956 B2
(45) Date of Patent: Jan. 22, 2013

(54) COROTRON DEVICE FOR A MOVING ELEMENT MOVING VIA A GUIDE UNIT

(75) Inventors: Florian Eder, Abensberg (DE); Johannes Thanner, Munich (DE)

(73) Assignee: Océ Printing Systems GmbH, Poing (DE)

( * ) Notice: Subject to any disclaimer, the term of this patent is extended or adjusted under 35 U.S.C. 154(b) by 425 days.

(21) Appl. No.: 12/727,457

(22) Filed: Mar. 19, 2010

(65) Prior Publication Data

US 2010/0239320 A1 Sep. 23, 2010

(30) Foreign Application Priority Data

Mar. 19, 2009 (DE) ..... 10 2009 013 972

(51) Int. Cl.
*G03G 15/02* (2006.01)
*G03G 15/16* (2006.01)

(52) U.S. Cl. ..... 399/121; 399/170; 399/311

(58) Field of Classification Search ..... 399/115, 399/121, 170, 297, 311, 172
See application file for complete search history.

(56) References Cited

U.S. PATENT DOCUMENTS

| | | | | |
|---|---|---|---|---|
| 4,466,729 | A | 8/1984 | Iwata | |
| 4,835,568 | A | 5/1989 | Howard et al. | |
| 5,126,796 | A * | 6/1992 | Fujii et al. | 399/297 |
| 6,787,774 | B1 | 9/2004 | Rumpel et al. | |
| 2008/0205920 | A1 | 8/2008 | Kreiter et al. | |

FOREIGN PATENT DOCUMENTS

| | | |
|---|---|---|
| DE | 199 57 615 | 6/2001 |
| DE | 10 2005 023 462 A1 | 11/2006 |

* cited by examiner

*Primary Examiner* — William J Royer
(74) *Attorney, Agent, or Firm* — Schiff Hardin LLP

(57) ABSTRACT

In a corotron device, a moving element moves via a guide unit. A corotron having a corotron element and a corotron shield is provided. The corotron element is arranged relative to the guide unit such that a distance from, and a parallel position of, the corotron element relative to the guide unit substantially do not change.

15 Claims, 6 Drawing Sheets

COROTRON DEVICE FOR A MOVING ELEMENT MOVING VIA A GUIDE UNIT

BACKGROUND

Corotrons are frequently used in electrographic printing apparatuses in order to generate an electrical field with which photoconductor elements, transfer elements or recording media (for example) have their charges reversed.

As an example, from US 2008/0205920 A1 an electrographic printing apparatus is known with which a printing substrate is printed simultaneously on both sides. Toner images are generated in a same manner in an upper printing group and lower printing group and are transfer-printed onto the printing substrate in a transfer printing station. In order to be able to simultaneously transfer-print the toner images onto the printing substrate, the toner images on a transfer belt must have their charges reversed. For this a corotron made of a corotron shield and a corotron wire is used that is arranged adjacent to a roller around which the transfer belt is deflected. Refer to US 2008/0205920 A1 for details and US 2008/0205920 A1 is incorporated herein by reference.

The efficiency of the charge reversal depends on, among other things, a charge reversal current. This is directed from the corotron via ionized air to the transfer belt, where it reverses the charge of the toner image, and finally discharges via the roller. A distance between the corotron element and the roller is decisive for a voltage at the corotron shield and the roller.

Since the distance between the corotron element and the roller has an effect on the print quality, it is important that the distance between corotron element and roller is maintained.

SUMMARY

An object is to specify a corotron device in which the problems indicated above are avoided. It is thereby to be noted that it should be possible to move the corotron away from the roller, for example, in order to be able to exchange a moving element (for example a belt) and in order to be able to exchange the corotron wire of the corotron.

In a corotron device, a moving element moves via a guide unit. A corotron having a corotron element and a corotron shield is provided. The corotron element is arranged relative to the guide unit such that a distance from, and a parallel position of, the corotron element relative to the guide unit substantially do not change.

DESCRIPTION OF THE PREFERRED EMBODIMENTS

Figure 1:
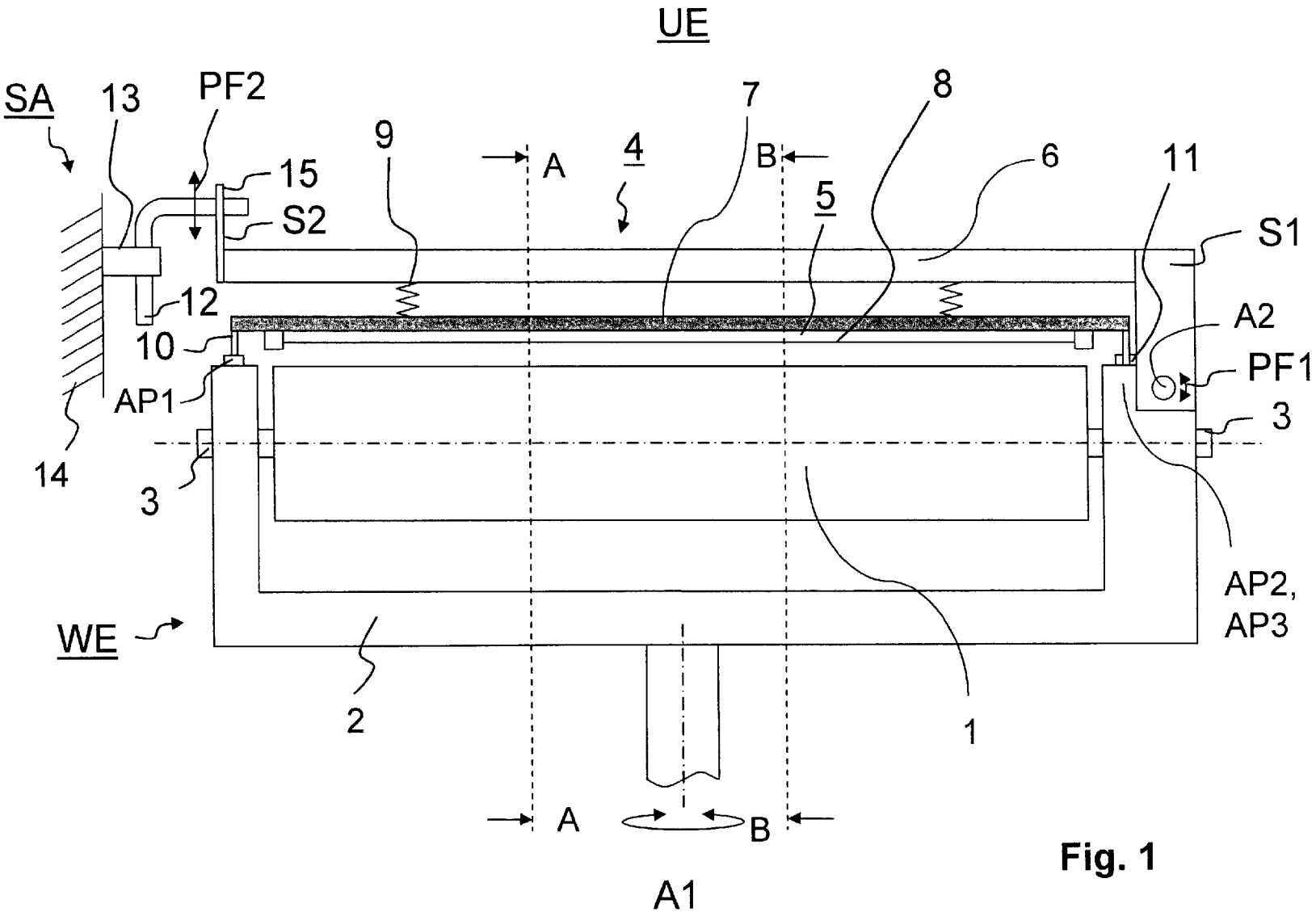
FIG. 1 is a view of a corotron device.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The preferred embodiments are described in the following in connection with a corotron device with which a belt (for example a transfer belt in an electrographic printing apparatus corresponding to US 2008/0205920 A1) has its charge reversed, and wherein the belt is directed via a roller. However, the preferred embodiments are not limited to this example; rather, it can be used anywhere a corotron interacts with a moving element. The moving element can be a belt, and a guide unit for the moving element can be a roller.

The corotron device has a corotron unit and a pivot arrangement for the corotron unit. The belt can have its charge reversed with the corotron unit; and the corotron unit can be pivoted towards the belt or away therefrom with the pivot arrangement.

For a belt directed via a roller executing pivot motions, the corotron unit has a corotron and a corotron suspension, wherein the corotron provides a corotron shield and a corotron element (for example a wire corotron). In the printing operation, the corotron is arranged fixed relative to the roller so that the separation and the parallel bearing of the corotron element relative to the roller do not change in the pivot movement of the roller; and the corotron element thus follows the roller. A roller unit made up of the roller and a roller suspension and the corotron form a unit that jointly executes the pivot movements in the print operation.

In order to be able to pivot the corotron away from the roller unit or towards it, the pivot arrangement is provided that interacts with the corotron unit so that the corotron can be pivoted away from the roller unit so that the belt or the corotron element can be exchanged. Upon pivoting towards the roller unit, the corotron is directed so that it is again connected in a fixed manner with the roller unit.

To transport a belt (for example a transfer belt shown in the drawing FIGS. 3 and 4 but not shown in FIGS. 1, 2, 5, 6, 7, and 8 for clarity) a roller unit WE as a guide unit made up of a roller 1 and a roller suspension 2 is provided. The roller 1 is borne in the roller suspension 2 as a guide unit suspension via an axle 3. The roller suspension 2 (and therefore the roller 1) can additionally be pivoted around an axle A1 transverse to the rotation direction of the roller 1. The roller 1 can be adapted to position changes of the belt via pivot movements around the axle A1.

FIG. 1 shows a corotron device UE, for example for a transfer belt corresponding to US 2008/0205920 A1. Toner images on the belt can have their charges reversed with the corotron device UE. The corotron device UE has a corotron unit 4 with a corotron 5 and a corotron suspension 6. The corotron 5 has a corotron shield 7 and a corotron wire 8 as a corotron element. The corotron 5 is attached to the corotron suspension 6 via springs 9. The corotron suspension 6 can be borne on one side S1 such that it can rotate on an axle A2 at the roller suspension 2; and the corotron suspension 6 is executed such that it can move freely on the other side S2.

The corotron device UE additionally has a pivot arrangement SA that is provided at the corotron suspension 6 at its other side S2. The corotron unit 4 can be pivoted away from the roller unit WE or towards this with the pivot arrangement SA.

In order to keep the distance from corotron wire 8 to roller 1 constant, and additionally to always keep the corotron wire 8 parallel to the roller 1 (even given pivot movements of the roller unit WE around the axle A1), the corotron 5 is arranged fixed relative to the roller 1 so that the wire corotron 8 follows the pivot movements of the roller 1. In order to achieve this, the corotron shield 7 is supported by support points apparatus at the roller suspension 2. For example, the corotron shield 7 can be supported with one side on two support points AP2, AP3 on the roller suspension 2 (for example in a guide 11); on the other side the corotron shield 7 can have an alignment pin 10 that can engage in a bore 22 of the roller suspension 2 (support point AP1, FIG. 4). In order to facilitate the sliding of the alignment pin 10 into the bore 22, the bore 22 can have a guide surface executed with a slope along which the alignment pin 10 can slide before it engages in the bore 22 (and therefore establish the bearing of the corotron shield 7 at the roller suspension 2). The corotron shield 7 is additionally pressed onto the roller suspension 2 with the elastic force of the springs 9, such that the corotron 5 remains rigidly coupled to the roller suspension 2 and follows the movements of the roller suspension 2 even given pivot movements of the roller suspension 2 around the axle A1.

In order to be able to change the belt or the corotron wire 8, the corotron unit 4 can be pivoted away from the roller suspension 2. For this the corotron suspension 6 is borne on one side S1 with the axle A2 in the roller suspension 2 such that the corotron suspension 6 can pivot. The other side S2 of the corotron suspension 6 has the pivot arrangement SA with which the corotron suspension 6 and the corotron 5 can be pivoted on the axle A2. For print operation, the corotron 5 is pivoted towards the roller suspension 2; and at the end of the pivot movement the corotron suspension 6 meets the roller suspension 2 at the support points AP2, AP3, the alignment pin 10 engages in the bore 22 at the support point AP1 in the roller suspension 2, and the rigid connection with the roller suspension 2 is therefore established in which it is held by the springs 9. In a pause operation, the corotron unit 4 (and therefore the corotron 5) can be pivoted from the roller suspension 2 in the arrow direction PF1. For this the pivot arrangement SA is operated so that the corotron unit 4 is pivoted away from the roller suspension 2 on the axle A2.

The corotron suspension 6 thereby carries along the corotron 5 by the springs 9 so that the corotron 5 is likewise pivoted away. An exchange of the corotron wire or a belt is then easily possible.

Figure 4:
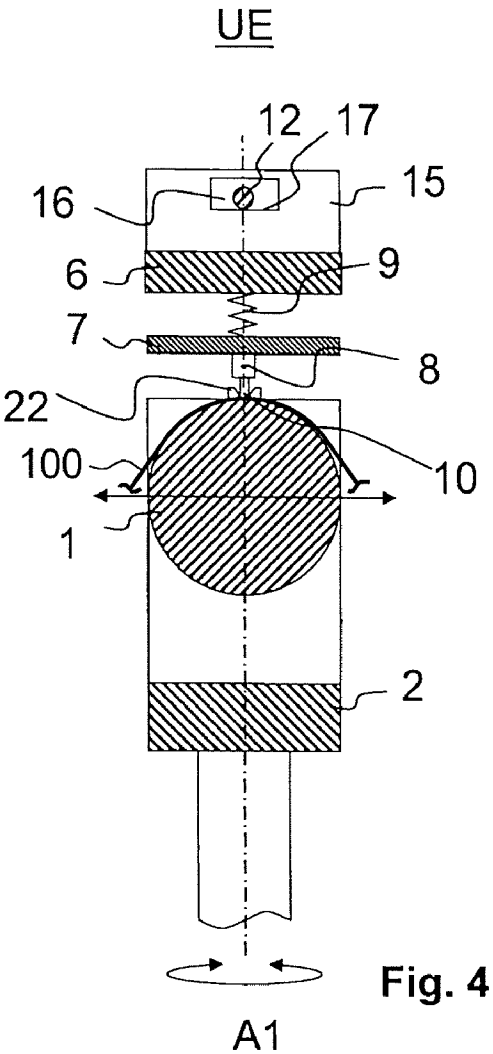
FIG. 4 is a section through the corotron device at a point B-B according to FIG. 1.

The pivot arrangement SA can be executed differently. For example, a lever arrangement can be used whose lever arm 12 is movable perpendicular to the roller suspension 2 (arrow PF2) and is borne with a first mount 13 at a housing wall 14. The lever arm 12 is furthermore directed optimally without friction in a second mount 15 that is attached to the corotron suspension 6. The second mount 15 provides for the lever arm 12 a slot (elongated hole) 16 with a running surface 17 for the lever arm 12 (FIG. 4). It is therefore ensured that pivot movements of the corotron suspension 6 cannot be transferred to the lever arm 12. The corotron unit 4 can thus move with the roller suspension 2. By shifting the lever arm 12, the corotron unit 4 can be pivoted around the axle A2.

Figure 2:
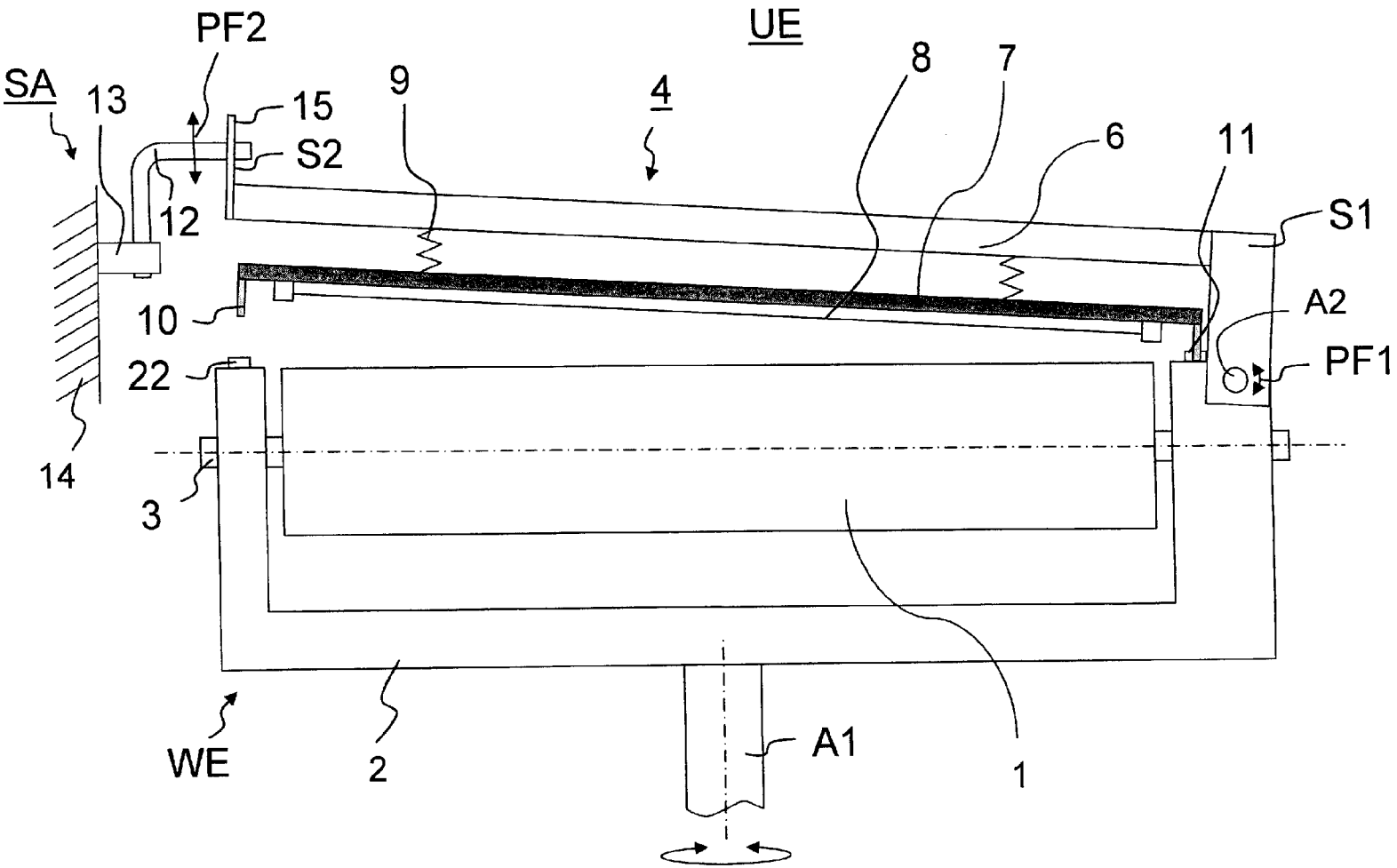
FIG. 2 shows the corotron device when a corotron unit is pivoted out.

FIG. 2 shows the corotron unit 4 in the pivoted-away state. If the lever arm 12 is raised in the first mount 13, it carries along the second mount 15 at the corotron suspension 6; and the corotron unit 4 thereby pivots around the axle A2. The corotron wire 8 or the belt is now accessible and can be exchanged, for example.

Figure 3:
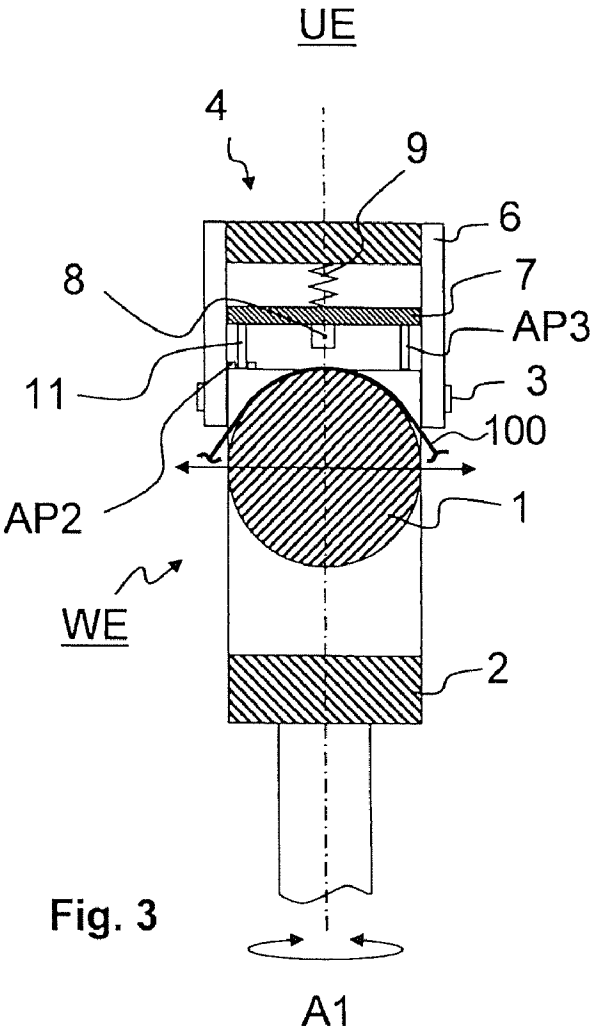
FIG. 3 is a section through the corotron device at a point A-A according to FIG. 1.

FIG. 3 shows a section through the corotron device UE and roller unit WE at the point A-A. The two support points AP2, AP3 are shown at which the corotron shield 7 is supported on the roller suspension 2. The corotron shield 7 is thereby engaged in the guide 11.

A section through the corotron device UE and the roller unit WE at the point B-B results from FIG. 4. In particular the second mount 15 for the lever arm 12 with the slot 16 is shown here. The lever arm 12 can thus slide back and forth on the running surface 17 in the slot 16 if the corotron suspension 6 moves with the roller unit WE; the lever arm 12 then does not move with this. The embodiment of the bore 22 and the coupling of the alignment pin 10 with the bore 22 can also be learned from FIG. 4.

Figure 5:
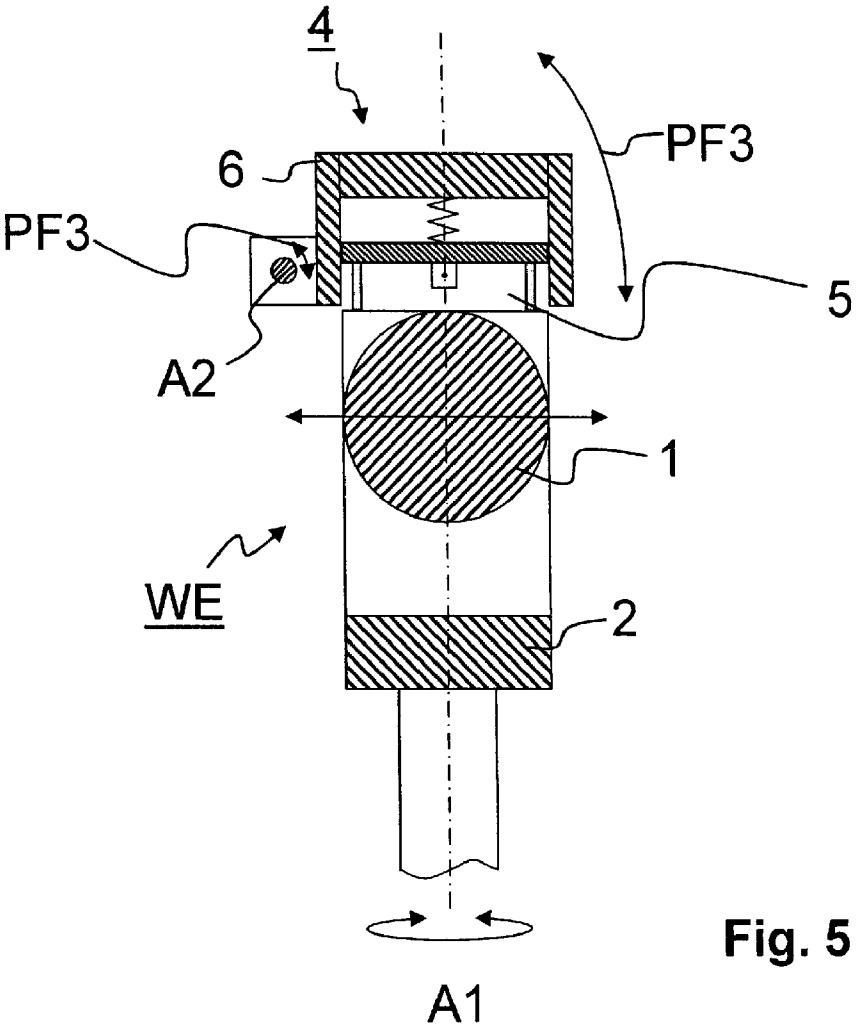
FIG. 5 is a section through the corotron device in a second embodiment of the invention.

A second embodiment of the bearing of the corotron unit 4 can be learned from FIG. 5. Here the axle A2 for the pivoting of the corotron unit 4 can be arranged laterally so that the corotron unit 4 can be tilted away from the roller unit WE in the arrow direction PF3.

Figure 6:
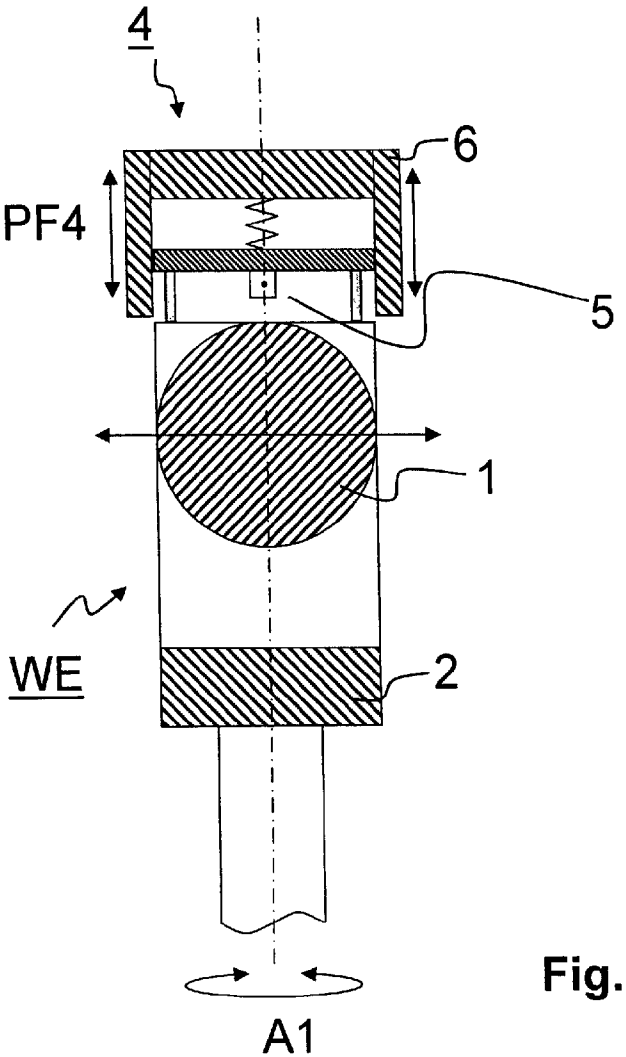
FIG. 6 is a section through a corotron device in a third embodiment of the invention.

Finally, the corotron unit 4 can be borne such that it can be raised in parallel in the arrow direction PF4 by the roller suspension 2 or can be placed on the roller suspension 2 (FIG. 6).

Figure 7:
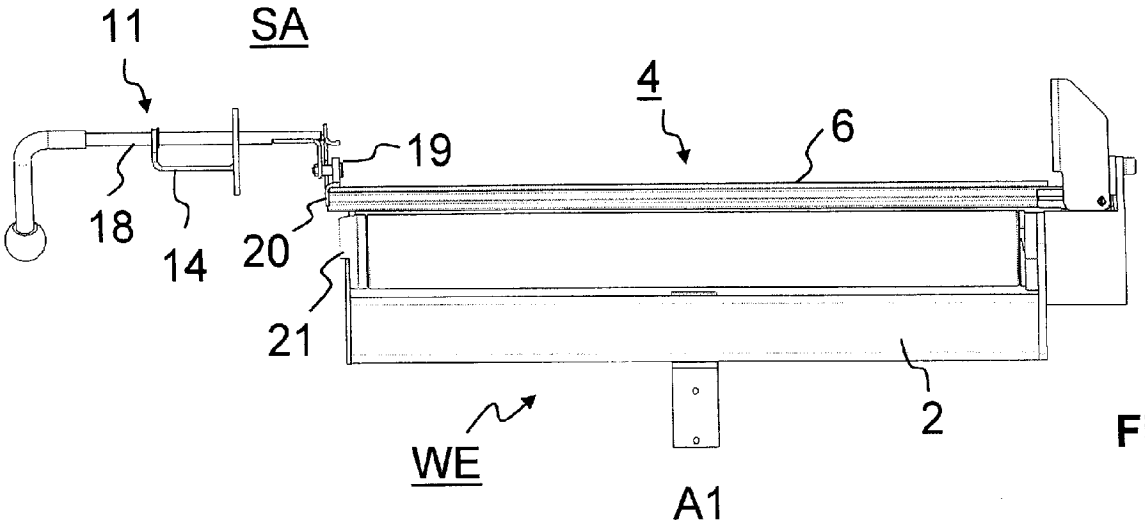
FIG. 7 is a view of a pivot arrangement in a pivoted-towards state.
Figure 8:
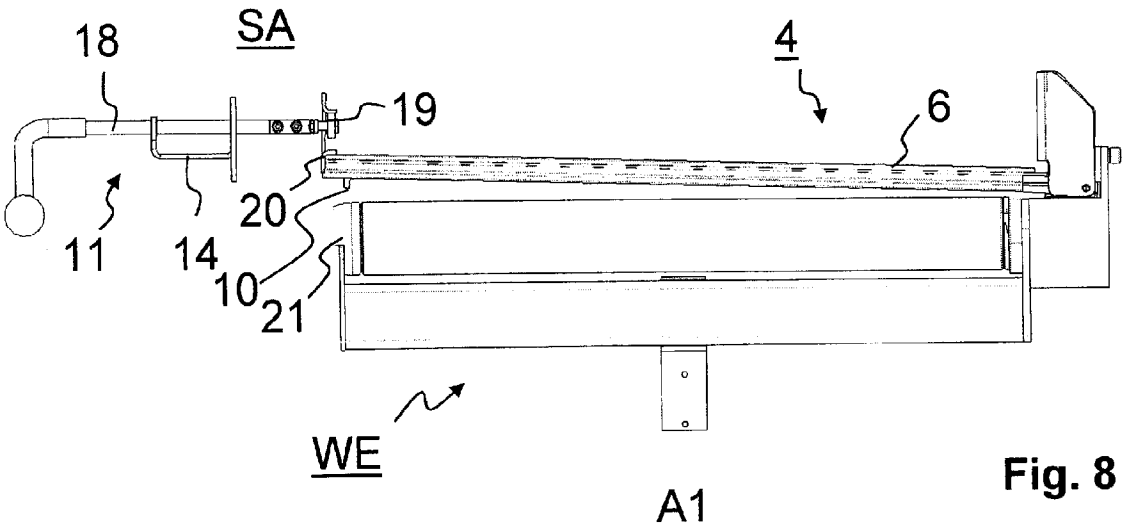
FIG. 8 is a view of a pivot arrangement in a pivoted-away state.

FIGS. 7 and 8 show a second embodiment of the pivot arrangement SA. Here swivel lever 18 is provided mounted on the housing plate 14, which swivel lever 18 has at its free end a ball bearing 19 that slides along a running surface 20 arranged at the corotron suspension 6 given the pivot motion of the roller unit WE. In the position of the swivel lever 18 according to FIG. 7, the ball bearing 19 is in its lower position, wherein the corotron suspension 6 rests on the roller suspension 2. By rotating the swivel lever 18 into the position of FIG. 8, the ball bearing 19 raises the corotron suspension 6, wherein the corotron unit 4 is pivoted away from the roller unit WE.

Upon pivoting the corotron unit 4 towards the roller unit WE, the alignment pin 10 engages in a flange 21 of the roller 1 and centers the corotron 5 relative to the roller 1.

The advantages of the preferred embodiments are apparent in the following points:

- A variation of the distance between the corotron element 8 and the roller 1 during the printing is precluded by the corotron unit 4 supported on the roller suspension 2. The distance, which is set once, remains the same for all positions of the roller suspension 2 since the corotron 5 follows the movement of the roller 1.
- The bearing of the corotron shield 7 can be determined in a self-centering manner by three support points AP1, AP2, AP3 given a pivoting corotron unit 4. For this reason a complicated and error-prone adjustment procedure for the corotron 5 is not necessary.
- The pivot arrangement SA to be operated manually functions independent of the position of the roller 1.
- In spite of the varying position of the roller 1, there is no effect on the control process for the roller 1 during the print operation due to the fixed position of the pivot arrangement SA.
- The disassembly and installation of the corotron unit 4 are very service-friendly and simple to operate dye to the suspended design.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim as our invention:

1. A corotron device, comprising:

a moving element moving via a guide unit;

a corotron having a corotron element and a corotron shield;

the corotron element arranged relative to the guide unit such that a distance from, and a parallel position of, the corotron element relative to the guide unit do not substantially change; and the guide unit for the moving element comprising a guide unit suspension, the corotron shield being supported at one side at a support surface of the guide unit suspension and at an opposite side at least one alignment pin engaged in a bore at another support surface of the guide unit suspension.

2. The corotron device according to claim 1 in which the corotron shield is supported on at least three support points of the guide unit suspension.

3. The corotron device according to claim 2 in which the corotron shield of the corotron is supported at said one side with two of said support points and said bore comprising a sloping guide surface at an entrance to the bore.

4. The corotron device according to claim 2 in which the guide unit can be pivoted on a pivot axis that is arranged on a longitudinal side of the guide unit suspension.

5. The corotron device according to claim 2 in which the corotron is arranged perpendicularly above the guide unit suspension such that it can pivot away.

6. The corotron device according to claim 1 in which a corotron suspension is provided at which the corotron shield is attached via springs, and wherein the springs exert an elastic force on the corotron shield in a direction towards the guide unit.

7. The corotron device according to claim 6 in which the corotron suspension is borne at one end such that it can pivot on the guide unit suspension, and in which the corotron suspension is borne at another end at a pivot arrangement such that the corotron is pivoted towards or away from the guide unit suspension under elastic force.

8. The corotron device according to claim 7 in which the pivot arrangement provides a lever arm borne such that it can be displaced at a housing wall, said lever arm being arranged such that it can be displaced perpendicular to the guide unit.

9. The corotron device according to claim 8 in which the corotron suspension has a slot aligned in a pivot direction of the guide unit, in said slot said lever arm engaging so that the guide unit suspension and the corotron suspension with the corotron can still pivot when said lever arm is stationary.

10. The corotron device according to claim 7 in which the pivot arrangement has a swivel lever at one end of which is provided a ball bearing, the ball bearing interacting with a running surface of the corotron suspension such that in one position of the swivel lever, the corotron suspension with the corotron is raised from the guide unit suspension, and in another position of the swivel lever said corotron suspension with the corotron is pressed against the guide unit suspension such that the alignment pin is engaged in the bore.

11. The corotron device according to claim 1 in which the corotron element comprises a corotron wire.

12. The corotron device according to claim 1 in which the guide unit comprises a roller.

13. An electrographic printing apparatus corotron device system, comprising:

a moving element moving via a guide unit, said moving element having toner images thereon;

a corotron having a corotron element and a corotron shield, said corotron element reversing a charge of said toner images on said moving element;

the corotron element arranged relative to the guide unit such that a distance from, and a parallel position of, the corotron element relative to the guide unit do not substantially change; and the guide unit for the moving element comprising a guide unit suspension, the corotron shield being supported at one side at a support surface of the guide unit suspension and at an opposite side at least one alignment pin engaged in a bore at another support surface of the guide unit suspension.

14. A corotron device, comprising:

a transfer belt with toner images and a guide roller having said transfer belt passing thereover, a longitudinal axis of said guide roller partially rotating about an axis perpendicular to said longitudinal axis;

a corotron having a corotron element and a corotron shield;

the corotron element being arranged relative to the transfer belt such that a distance of the corotron element from the guide roller does not substantially change, and a parallel position of a longitudinal extent of the corotron element relative to said longitudinal axis of said guide roller does not substantially change; and the guide roller for the transfer belt being mounted in a guide unit suspension, the corotron shield being supported at one side at a support surface of the guide unit suspension and at an opposite side at least one alignment pin engaged in a bore at another support surface of the guide unit suspension.

15. The corotron device of claim 14 wherein the corotron shield is supported on at least three support points at the guide unit suspension.

* * * * *